US007047735B2

(12) United States Patent
Sprinkle et al.

(10) Patent No.: US 7,047,735 B2
(45) Date of Patent: May 23, 2006

(54) INCREASING HYDRAULIC FLOW TO TRACTOR ATTACHMENTS

(75) Inventors: David LaVerne Sprinkle, Warrenton, GA (US); Daniel Joseph Goodman, Martinez, GA (US); Philip Carl Fernandez, Grovetown, GA (US)

(73) Assignee: Deere & Company, Moline, IL (US)

( * ) Notice: Subject to any disclaimer, the term of this patent is extended or adjusted under 35 U.S.C. 154(b) by 47 days.

(21) Appl. No.: 10/903,315

(22) Filed: Jul. 30, 2004

(65) Prior Publication Data

US 2006/0021338 A1 Feb. 2, 2006

(51) Int. Cl.
*F16D 31/02* (2006.01)

(52) U.S. Cl. ..... 60/422; 60/421

(58) Field of Classification Search ..... 60/420, 60/421, 422, 430
See application file for complete search history.

(56) References Cited

U.S. PATENT DOCUMENTS

| | | | | |
|---|---|---|---|---|
| 3,796,336 | A | 3/1974 | Ratliff | 214/762 |
| 3,894,606 | A | 7/1975 | Hunck et al. | 180/66 R |
| 4,061,201 | A | 12/1977 | Dunn | 180/133 |
| 4,170,168 | A | 10/1979 | Jenkins | 91/522 |
| 4,622,886 | A | 11/1986 | Imada et al. | 91/520 |
| 4,779,416 | A | 10/1988 | Chatterjea et al. | 60/429 |
| 5,081,837 | A | 1/1992 | Ueno | 60/421 |
| 5,289,680 | A * | 3/1994 | Obe et al. | 60/422 |
| 5,316,435 | A | 5/1994 | Mozingo | 414/685 |
| 5,323,687 | A | 6/1994 | Zenker et al. | 91/449 |
| 5,413,452 | A * | 5/1995 | Lech et al. | 60/422 |
| 5,832,729 | A * | 11/1998 | Reid et al. | 60/421 |
| 6,223,848 | B1 | 5/2001 | Young et al. | 180/242 |
| 6,618,659 | B1 * | 9/2003 | Berger et al. | 60/420 |
| 6,651,426 | B1 | 11/2003 | Lange | 60/421 |
| 6,662,556 | B1 | 12/2003 | Bares et al. | 60/422 |
| 6,672,399 | B1 | 1/2004 | Sprinkle et al. | 172/7 |

* cited by examiner

*Primary Examiner*—Edward K. Look
*Assistant Examiner*—Michael Leslie

(57) ABSTRACT

Hydraulic flow to tractor attachments such as a sweeper, snow thrower, breaker, auger or cold planer may be increased by diverting pressurized hydraulic fluid from the auxiliary pump. A diverter valve between the auxiliary pump and the auxiliary circuit of the loader hydraulic system may direct flow to either the backhoe hydraulic system, the rockshaft hydraulic system, or the auxiliary circuit of the loader hydraulic system. The additional flow from the auxiliary pump is provided at a mid-inlet position and is not available to the loader boom or bucket circuits, to preserve tractive horsepower needed during loader work.

26 Claims, 3 Drawing Sheets

INCREASING HYDRAULIC FLOW TO TRACTOR ATTACHMENTS

FIELD OF THE INVENTION

The present invention relates to utility vehicles, such as industrial or agricultural tractors. Particularly, the invention relates to tractors having one or more hydraulically powered attachments.

BACKGROUND OF THE INVENTION

Utility vehicles typically include an internal combustion engine, which delivers power to a transmission and ultimately to a wheel for traction, and also delivers power to pressurize hydraulic fluid, via one or more pumps, to operate hydraulic tools or implements.

For example, a tractor may have three hydraulic pumps driven from the engine. A first pump may provide pressurized hydraulic fluid to charge a steering cylinder of the vehicle. A second or "main" pump is usually fixed directly to the crankshaft of the engine and may be used to charge pressurized hydraulic fluid to the loader and the backhoe hydraulic cylinders.

A third or "auxiliary" pump may generate pressurized hydraulic fluid to charge a power takeoff clutch pack and at least one hydraulic cylinder which operates a three point hitch or "rockshaft." The power takeoff is a shaft that is rotated by the vehicle transmission and is used for supplying rotational power to tools, such as mower decks, where rotation is required.

In small utility tractors, the first or steering pump typically requires about 1.4 to about 8 horsepower, depending on steering demand, and about 22 L/min (about 6 gallons per minute) of hydraulic fluid. The second or "main" pump typically requires about 3.2 to about 21.3 horsepower, depending on demand from loader or backhoe hydraulic systems, and about 46 L/min (about 12 gallons per minute) of hydraulic fluid. The third or "auxiliary" pump typically requires about 1 to about 9.5 horsepower, depending on demand from the rockshaft circuit, and about 20 L/min (about 5 gallons per minute) of hydraulic fluid. The engine for a small utility tractor typically delivers about 25 to 50 horsepower.

When a hydraulically powered attachment such as a sweeper, snow thrower, breaker, auger or cold planer is attached to a utility vehicle, the rockshaft may not be needed, nor is it practically operable. The present inventors have recognized the desirability of diverting hydraulic fluid that would otherwise supply the rockshaft when an attachment such as a sweeper, snow thrower, breaker, auger or cold planer is used. Furthermore, the present inventors have recognized the desirability of using the circulating hydraulic fluid otherwise available to the rockshaft to improve the effectiveness and efficiency of the utility vehicle.

Hydraulically powered attachments such as a sweeper, snow thrower, breaker, auger or cold planer are typically attached to the utility vehicle loader in place of the loader bucket. These attachments may be raised and positioned using the boom and bucket hydraulic cylinders.

The present inventors have recognized that a proper balance of available engine horsepower directed to the various tractor functions at the proper time is required for best operation of the machine. For example, U.S. Pat. No. 6,672,399 assigned to Deere and Company of Moline, Ill. relates to a method and apparatus for diverting pressurized hydraulic fluid, otherwise available to a utility vehicle rockshaft system, to be used by a backhoe hydraulic system.

While the loader is in use, the transmission must necessarily also be in use simultaneously. As such, it is desirable to limit the available horsepower consumed in the operation of the loader while demands are placed on the transmission, to prevent the engine from stalling. Furthermore, it is desirable to limit the hydraulic flow to the boom and bucket circuits so that the boom and bucket do not move too fast, but move at an appropriate rate.

The inventors also have recognized that hydraulically powered attachments such as a sweeper, snow thrower, breaker, auger or cold planer are used without high demand on the transmission, backhoe, rockshaft, or steering circuits. Furthermore, the inventors have recognized that it would be desirable to utilize additional flow from tractor hydraulic systems which are sitting idle while such an attachment is in use.

SUMMARY OF THE INVENTION

The present invention provides an apparatus for diverting pressurized hydraulic fluid, otherwise available to a utility vehicle rockshaft, to be used by a hydraulically powered attachment such as a sweeper, snow thrower, breaker, auger or cold planer. Particularly, the invention provides a method and apparatus for diverting pressurized hydraulic fluid from the rockshaft system to be available to a hydraulically powered attachment. Additionally, the invention provides a method and apparatus to divert pressurized hydraulic fluid for an attachment without reducing tractive horsepower the loader needs when it is in use.

The apparatus of the invention may be advantageously accomplished by use of an auxiliary diverter valve connected to the auxiliary pump. The auxiliary diverter valve can direct pressurized hydraulic fluid from the auxiliary pump to either the backhoe system, the rockshaft system, or the auxiliary circuit of the loader hydraulic system.

The auxiliary diverter valve may be connected to a mid-inlet position of the loader hydraulic system. Pressurized hydraulic fluid from the auxiliary pump may be available to the auxiliary circuit of the loader hydraulic system, and not to the boom and bucket circuits. Additional hydraulic flow is made available to an attachment such as a sweeper, snow thrower, breaker, auger or cold planer, allowing for faster movement of the operating cylinders or other hydraulic devices of the attachment, and thus faster and/or more efficient operation of the attachment.

Numerous other advantages and features of the present invention will become readily apparent from the following detailed description of the invention and the embodiments thereof, from the claims and from the accompanying drawings.

DESCRIPTION OF THE PREFERRED EMBODIMENT

Figure 1:
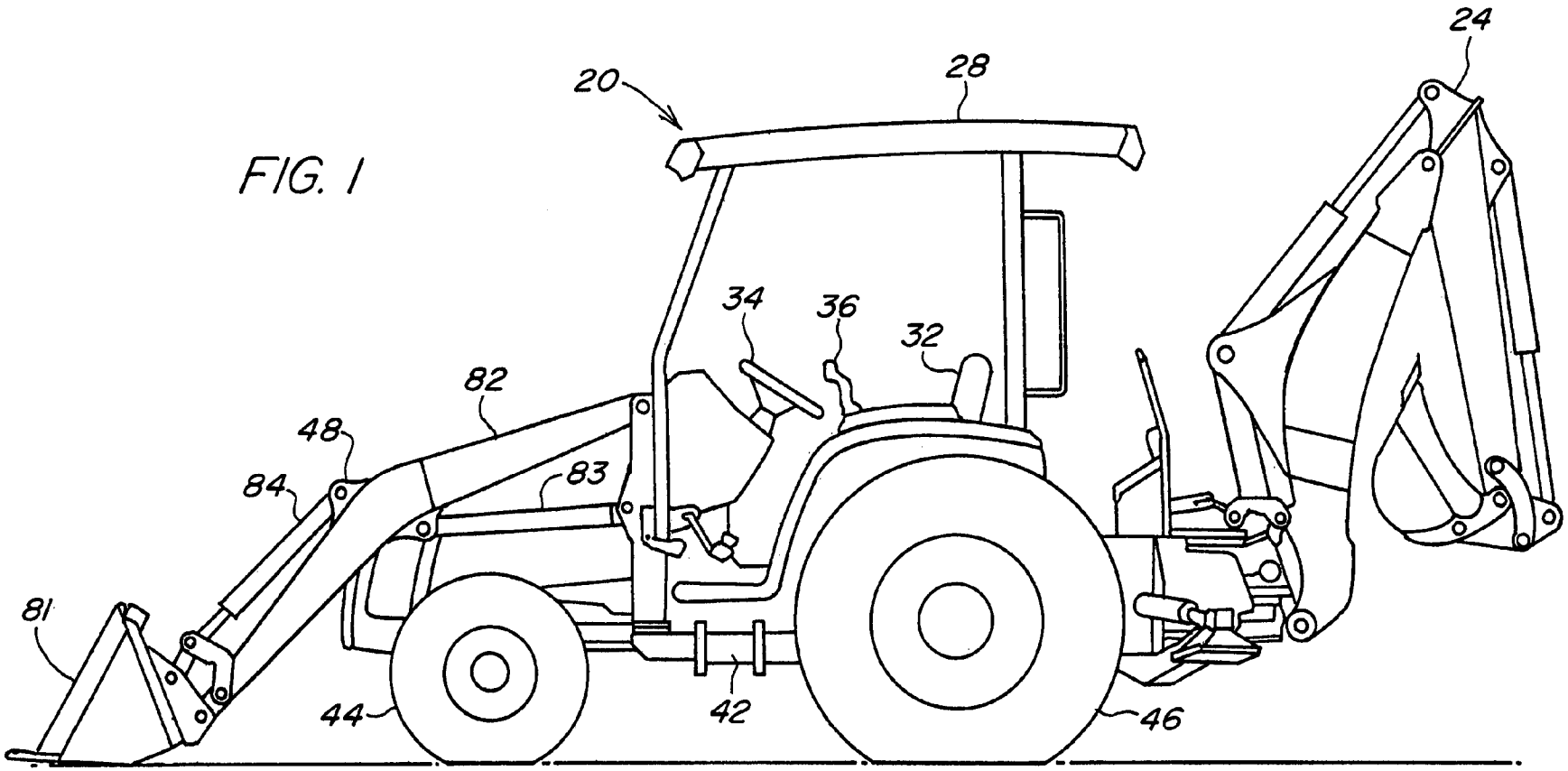
FIG. 1 is a side view of a tractor incorporating the present invention with a front mounted loader.

FIG. 1 illustrates utility vehicle 20 such as a tractor with an attachable rear-mounted implement, such as backhoe 24, and a front mounted loader assembly 48. Utility vehicle 20 may include cab or operator's station 28 including seat 32, steering wheel 34, and loader controls 36. The loader controls may include a selective control valve which may serve a single function or several functions. The cab may be supported on chassis 42 which is supported on front wheels 44 and larger rear wheels 46. The invention may be used with any size and type utility tractor, but is particularly useful for small utility tractors of the general size and type shown in FIG. 1.

The loader assembly may include bucket 81 and boom 82. Hydraulic cylinder 83 may raise and lower the boom, and hydraulic cylinder 84 may actuate the bucket between load holding and dumping positions. Cylinders 83, 84 may be double-acting.

Figure 3:
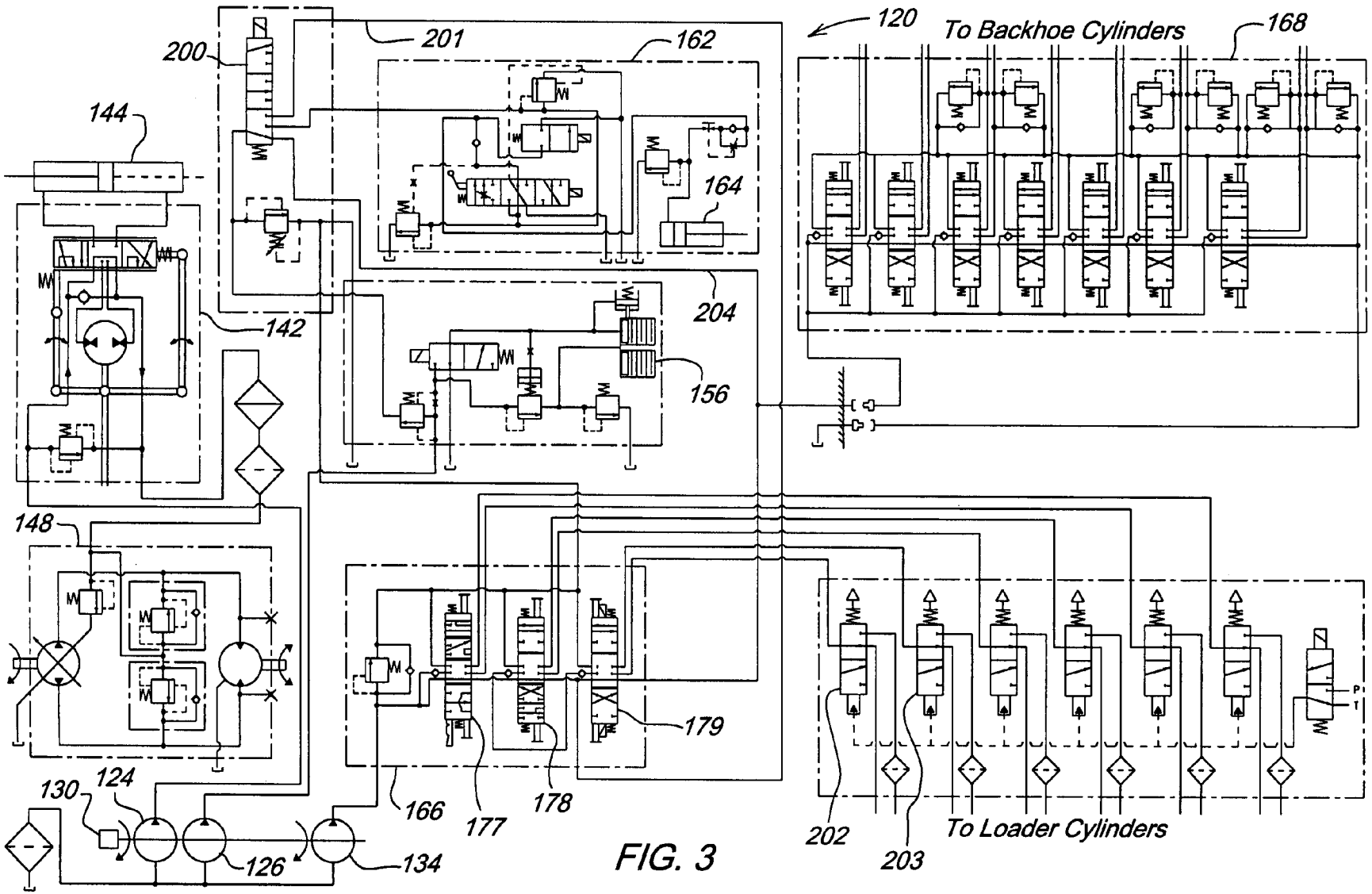
FIG. 3 is a schematic diagram of a hydraulic fluid system according to an embodiment of the invention.

As shown in the schematic of FIG. 3, the boom or lift circuit may be served by first control valve 177, and the bucket or tilt circuit may be served by second control valve 178. The first or boom control valve 177 and the second or bucket control valve 178 may be spool or cartridge valves within a mono block or bolted together, and controlled by an operator with loader controls 36 such as a selective control valve.

Figure 2:
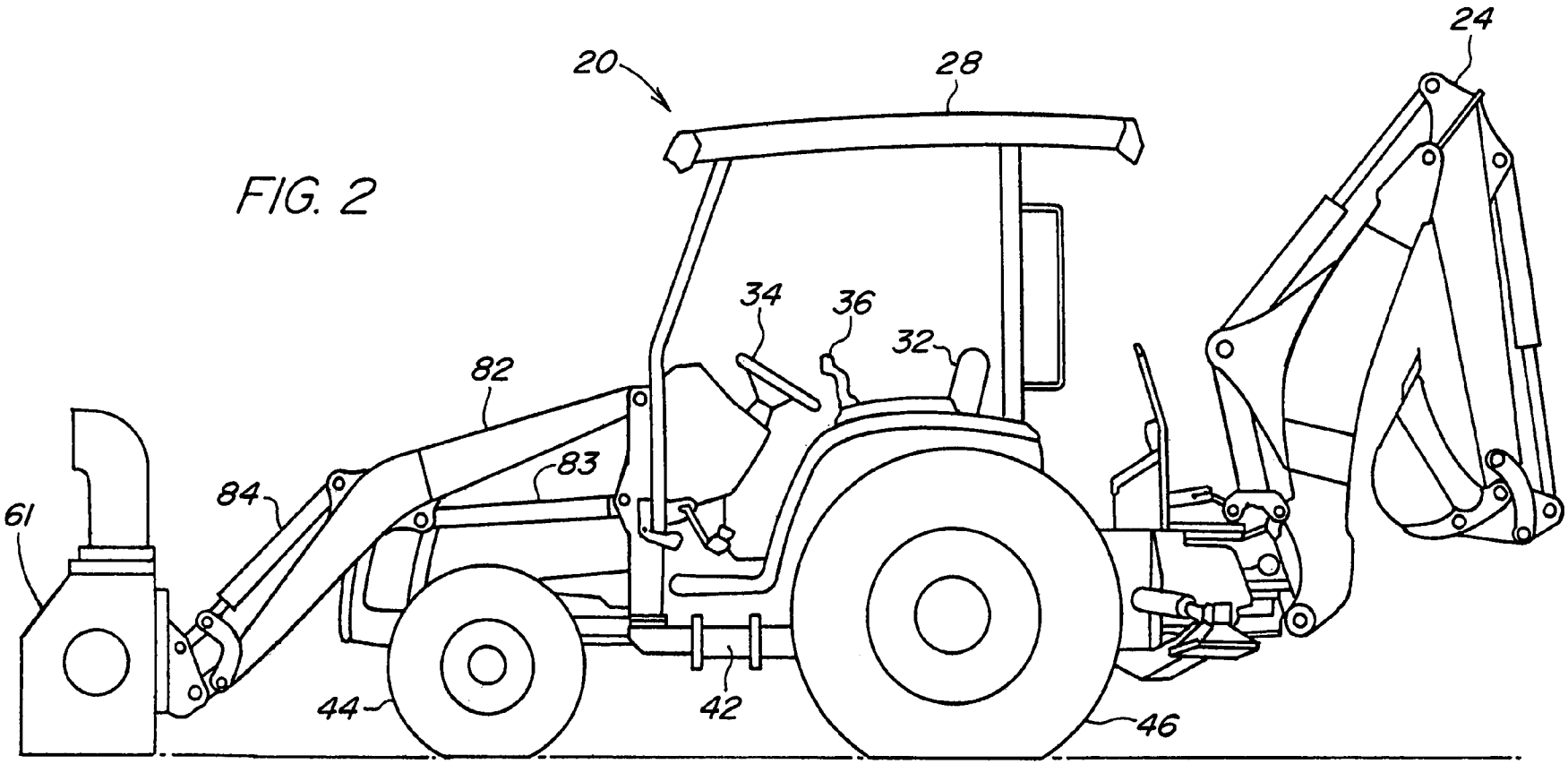
FIG. 2 is a side view of the tractor of FIG. 1 with a snow thrower attachment.

Various hydraulically powered auxiliary attachments such as a sweeper, snow thrower, breaker, auger or cold planer may be attached to the vehicle loader. For example, as shown in FIG. 2, the loader bucket may be removed so that snow thrower 61 may be attached to the boom 81 at the front end of tractor 20 in place of the bucket. The hydraulically powered attachment may have a hydraulic motor connected by fluid lines to the auxiliary circuit of the loader hydraulic system.

The auxiliary circuit of the loader hydraulic system may be served by a third or auxiliary control valve 179 shown in FIG. 3. The third or auxiliary control valve also may be a spool or cartridge valve in a mono block or bolted together with the boom and bucket control valves 177 and 178, and also may be controlled using loader controls 36. Alternatively, the auxiliary attachment may be served by an auxiliary control valve that is a separate or "add-on" device, not in a mono body with the boom and bucket control valves.

FIG. 3 illustrates hydraulic system 120 in one embodiment of the invention. Hydraulic system 120 may be charged by three pumps. Steering pump 124 and auxiliary pump 126 may be driven by the auxiliary drive of engine 130. Main pump 134 may be driven by the crankshaft of engine 130.

In one embodiment, steering pump 124 may charge power steering system 142 and ultimately powers steering cylinder 144. Hydraulic fluid out of steering system 142 may charge hydrostatic transmission 148 which transfers power from the engine to the utility vehicle gear train.

In one embodiment, main pump 134 may charge loader hydraulic system 166 which may include a loader selective control valve, and backhoe hydraulic system 168 which may include a backhoe selective control valve. The loader selective control valve may include a lever which operates the first or boom control valve 177 and the second or bucket control valve 178. The first or boom control valve 177 is part of the boom circuit which may include one or more double acting hydraulic cylinders used to raise or lower the boom. The second or bucket control valve is part of the bucket circuit which may include hydraulic cylinders to control movements of the bucket. Similarly, the backhoe selective control valve may include a lever which operates control valves connected to hydraulic cylinders which control movements of the backhoe, including cylinders for the bucket, dipper, stabilizer, boom and swing.

In one embodiment, auxiliary pump 126 may charge power takeoff system clutch pack 156, and either rockshaft hydraulic system 162, backhoe hydraulic system 168, or the auxiliary circuit of loader hydraulic system 166.

In one embodiment, when the auxiliary pump is connected to rockshaft hydraulic system 162, the pump may direct hydraulic fluid through a rockshaft selective control valve which powers at least one rockshaft hydraulic cylinder. The hydraulic cylinder(s) may control vertical and/or attitude and/or pitch adjustment of the three point hitch. When the auxiliary pump is connected to backhoe hydraulic system 168, the pump may direct hydraulic fluid through a backhoe selective control valve which may include control valves that power several hydraulic cylinders.

When the auxiliary pump is connected to auxiliary control valve 179, the pump may direct hydraulic fluid through an auxiliary hydraulic circuit of the loader hydraulic system. The auxiliary circuit include auxiliary control vale 179 and one or more valves 202, 203 that may be coupled to hydraulically powered attachments such as a sweeper, snow thrower, breaker, auger or cold planer. The attachment may have a hydraulic motor. In one embodiment, the attachment may be operated by use of a loader selective control valve.

In one embodiment, an auxiliary diverter valve in the form of spool or cartridge valve 200 may be hydraulically connected to pressurized hydraulic fluid from auxiliary pump 126. The auxiliary diverter valve may have several positions including a first position to deliver pressurized hydraulic fluid to rockshaft hydraulic system 162, a second position to deliver pressurized hydraulic fluid to backhoe hydraulic system 168, and a third position to deliver pressurized hydraulic fluid to auxiliary control valve 179 of the loader hydraulic system.

By diverting hydraulic fluid to the auxiliary circuit of the loader hydraulic system, the auxiliary pump may be used to increase total pump capacity to a hydraulically powered attachment such as a sweeper, snow thrower, breaker, auger or cold planer. The auxiliary pump previously represented unused capacity during operation of those hydraulically powered attachments.

The size of pump 134 is typically selected to correspond to the total horsepower demand of the front loader, via loader hydraulic system 166. The engine is typically sized to provide reserve horsepower over the demand of the loader to power the hydrostatic transmission during loader work, when the backhoe or other attachments are not in use. Thus, according to one embodiment of the invention, sufficient engine horsepower is available to drive both pumps 126, 134 to supply an attachment such as a sweeper, snow thrower, breaker, auger or cold planer with increased hydraulic capacity. By diverting flow from the auxiliary pump to the auxiliary circuit, the overall horsepower required by the vehicle may be reduced. The invention may therefore be particularly advantageous to retrofit existing utility vehicles or existing designs for utility vehicles.

In one embodiment, the auxiliary diverter valve may have a mid-inlet connection position to the loader hydraulic system so that hydraulic flow from the auxiliary pump is available only to the third or auxiliary control valve, and not to the first or boom control valve or to the second or bucket control valve of the loader hydraulic system. Attachments such as a sweeper, snow thrower, breaker, auger or cold planer typically do not use high hydraulic pressures, and do not require high tractive horsepower from the vehicle hydrostatic transmission. In contrast, the loader boom and bucket circuits require high pressures and, during loader operation, high tractive horsepower is needed from the vehicle.

Thus, hydraulic flow from the auxiliary pump may be diverted to the auxiliary circuit of the loader hydraulic system when an attachment is used. With additional flow from the auxiliary pump, total hydraulic flow available to the attachment may be at least about 20% higher than the hydraulic flow from the main pump alone. For example, in one embodiment, with additional flow from the auxiliary pump, total hydraulic flow available to an attachment may be about 60 L/min (about 16 gallons per minute), compared to about 46 L/min (12 gallons per minute) from the main pump alone.

In accordance with one embodiment of the invention, hydraulic flow from the auxiliary pump is not diverted to the boom or bucket control valves of the loader hydraulic system. As a result, sufficiently high tractive horsepower remains available when the loader is used so that the vehicle's engine will not stall out.

In one embodiment, auxiliary diverter valve 200 may be connected via fluid line 201 to a mid-inlet position of the loader hydraulic system. In this embodiment, fluid line 201 is connected downstream of boom and bucket control valves 177, 178. For example, fluid line 201 may be connected to a neutral core line between the bucket or boom control valves and auxiliary control valve 179. In this embodiment, hydraulic flow from the auxiliary pump through the auxiliary diverter valve may be available to the auxiliary control valve and auxiliary circuit only.

In an alternative embodiment, hydraulic flow from the auxiliary pump through the auxiliary diverter valve also may be available to the backhoe hydraulic system. For example, the auxiliary diverter valve may have only two positions, i.e., a first position directing hydraulic fluid to the rockshaft hydraulic system, and a second position directing hydraulic fluid to either the backhoe hydraulic system or the auxiliary circuit of the loader hydraulic system. In this alternative embodiment, the auxiliary control valve may be used to select either the backhoe and the auxiliary circuit of the loader hydraulic system. As a result, fluid line 204 may not be needed for this alternative embodiment.

In one embodiment, sufficient flow from the auxiliary pump may be diverted to the auxiliary control valve and auxiliary circuit so that most of the engine power is provided to the hydraulically powered attachment. For example, in one embodiment, about 75 percent of the available engine horsepower may be available for the main and auxiliary hydraulic pumps when a hydraulically powered attachment is used. In contrast, when the loader is being used, only about 50 percent of the available engine horsepower may be available to the main hydraulic pump, with the remainder may be available as tractive horsepower. When the rockshaft is in use, the auxiliary pump uses only about 25 percent of the available engine horsepower. These examples are representative for a small utility tractor that are capable of reducing tractive power if the engine slows excessively due to the loader hydraulic circuits.

Having described the preferred embodiment, it will become apparent that various modifications can be made without departing from the scope of the invention as defined in the accompanying claims.

The invention claimed is:

1. An apparatus comprising:

a tractor having an engine, a main hydraulic pump and an auxiliary hydraulic pump, the pumps being driven by the engine;

a loader hydraulic system having a first valve for operating a boom, a second valve for operating a bucket, and a third valve for operating an auxiliary hydraulic circuit;

the auxiliary hydraulic pump connected via fluid lines to provide a flow of pressurized hydraulic fluid to the third valve of the loader hydraulic system; and a diverter valve between the auxiliary hydraulic pump and the loader hydraulic system, the diverter valve configured to control direction of the flow of pressurized hydraulic fluid to the third valve of the loader hydraulic system.

2. The apparatus of claim 1 further comprising a backhoe hydraulic system, the diverter valve configured to control flow of pressurized hydraulic fluid to either the third valve of the loader hydraulic system or the backhoe hydraulic system.

3. The apparatus of claim 2 wherein the main hydraulic pump is selectively connectable to the loader hydraulic system or the backhoe hydraulic system.

4. The apparatus of claim 1 wherein the diverter valve is a three position valve.

5. The apparatus of claim 1 further comprising a power steering hydraulic pump driven by the engine.

6. The apparatus of claim 1 further comprising a rockshaft hydraulic system, the diverter valve configured to control flow of pressurized hydraulic fluid to either the third valve of the loader hydraulic system or the rockshaft hydraulic system.

7. An apparatus comprising:

a loader selective control valve having a first valve to control flow of pressurized hydraulic fluid to a first hydraulic circuit having at least one cylinder to raise or lower a loader boom, a second valve to control flow of pressurized hydraulic fluid to a second hydraulic circuit having at least one cylinder to dump or rollback a loader bucket, and a third valve to control flow of pressurized hydraulic fluid to a third hydraulic circuit connectable to a hydraulically powered attachment;

the loader selective control valve connectable to a first source of pressurized hydraulic fluid available to the first, second and third hydraulic circuits, and a second source of pressurized hydraulic fluid available to only the third hydraulic circuit.

8. The apparatus of claim 7 further comprising a backhoe selective control valve having a plurality of valves to control flow of pressurized hydraulic fluid to a plurality of hydraulic circuits having at least one cylinder each, all of the backhoe hydraulic circuits being connectable to the first and the second sources of pressurized hydraulic fluid.

9. The apparatus of claim 8 further comprising a diverter valve between the second source of pressurized hydraulic fluid and either the third hydraulic circuit or the backhoe hydraulic circuits.

10. The apparatus of claim 7 further comprising a rockshaft control valve having a plurality of valves to control flow of pressurized hydraulic fluid to a plurality of hydraulic circuits having at least one cylinder each, all of the rockshaft hydraulic circuits being connectable to the second source of pressurized hydraulic fluid.

11. The apparatus of claim 10 further comprising a diverter valve between the second source of pressurized hydraulic fluid and either the third hydraulic circuit or the rockshaft hydraulic circuits.

12. The apparatus of claim 7 further comprising a diverter valve between the second source of pressurized hydraulic fluid and the third hydraulic circuit.

13. The apparatus of claim 7 wherein the hydraulically powered attachment is a sweeper.

14. The apparatus of claim 7 wherein the hydraulically powered attachment is a snow thrower.

15. The apparatus of claim 7 wherein the hydraulically powered attachment is a breaker.

16. The apparatus of claim 7 wherein the hydraulically powered attachment is an auger.

17. The apparatus of claim 7 wherein the hydraulically powered attachment is a cold planer.

18. An apparatus comprising:

a main hydraulic pump connected to a tractor engine, the main pump connected via fluid lines to either a loader hydraulic system or a backhoe hydraulic system; the loader hydraulic system having at least two valves to control hydraulic flow from the main pump to a boom circuit and a bucket circuit, and at least one valve to control hydraulic flow to an auxiliary circuit;

an auxiliary hydraulic pump connected to the tractor engine, the auxiliary pump connected via fluid lines to either the backhoe hydraulic system, a rockshaft hydraulic system, or the auxiliary circuit of the loader hydraulic system; and a diverter valve connected via fluid lines to the auxiliary hydraulic pump, the diverter valve being selectively movable to direct flow of hydraulic fluid from the auxiliary pump to the backhoe hydraulic system, the rockshaft hydraulic system, or the auxiliary circuit of the loader hydraulic system.

19. The apparatus of claim 18 further comprising a sweeper connected to the auxiliary circuit of the loader hydraulic system.

20. The apparatus of claim 18 further comprising a snow thrower connected to the auxiliary circuit of the loader hydraulic system.

21. The apparatus of claim 18 further comprising a breaker connected to the auxiliary circuit of the loader hydraulic system.

22. The apparatus of claim 18 further comprising an auger connected to the auxiliary circuit of the loader hydraulic system.

23. The apparatus of claim 18 further comprising a cold planer connected to the auxiliary circuit of the loader hydraulic system.

24. The apparatus of claim 18 further comprising a power takeoff clutch pack connected via fluid lines to the auxiliary hydraulic pump.

25. The apparatus of claim 18 wherein the main hydraulic pump provides a flow rate greater than that of the auxiliary hydraulic pump.

26. The apparatus of claim 18 further comprising a steering hydraulic pump connected via fluid lines to a power steering cylinder.

* * * * *